US005830334A

United States Patent [19]

Kobayashi

[11] Patent Number: 5,830,334

[45] Date of Patent: Nov. 3, 1998

[54] NOZZLE FOR FAST PLATING WITH PLATING SOLUTION JETTING AND SUCTIONING FUNCTIONS

[76] Inventor: Hideyuki Kobayashi, 1-11-11, Omiya-cho, Mishima-shi, Shizuoka-ken, Japan

[21] Appl. No.: 746,290

[22] Filed: Nov. 7, 1996

[51] Int. Cl.[6] ..... C25D 17/00

[52] U.S. Cl. ..... 204/224 R; 204/275; 204/279; 205/133; 205/148; 239/104

[58] Field of Search ..... 205/133, 148, 205/670; 204/224 R, 224 M, 275, 279; 239/104; 118/300

[56] References Cited

U.S. PATENT DOCUMENTS

| | | | |
|---|---|---|---|
| 4,287,029 | 9/1981 | Shimamurd | 204/15 |
| 4,376,683 | 3/1983 | Hellwig et al. | 204/15 |
| 4,818,348 | 4/1989 | Smith | 204/15 |
| 5,372,700 | 12/1994 | Pilorge et al. | 205/131 |
| 5,382,343 | 1/1995 | Zwerner | 204/224 R |
| 5,397,453 | 3/1995 | Imori | 205/123 |

*Primary Examiner*—Kathryn L. Gorgos
*Assistant Examiner*—William T. Leader
*Attorney, Agent, or Firm*—Wenderoth, Lind & Ponack

[57] ABSTRACT

A nozzle for fast plating with plating solution jetting and sucking functions includes an outer cylindrical member and an inner cylindrical member, a plating solution issuing passage being defined between the outer and inner cylindrical members, and the inner space in the inner cylindrical member constituting a plating solution sucking passage. The inner cylindrical member has a front end flared portion having a forwardly flared surface acting to diffuse the solution. The outer cylindrical member has a front open end defining a gap with respect to the flared surface, the gap constituting a jetting port of the plating solution jetting passage. Plating solution supplied from a supply opening of the plating solution jetting passage is jetted from the jetting port toward a workpiece to be plated, the jetted plating solution is discharged from a rear end discharge opening of the plating solution sucking passage.

12 Claims, 4 Drawing Sheets

NOZZLE FOR FAST PLATING WITH PLATING SOLUTION JETTING AND SUCTIONING FUNCTIONS

BACKGROUND OF THE INVENTION

1. Field of the Invention

This invention relates to a nozzle for fast plating with plating solution jetting and sucking functions.

2. Description of the Prior Art

Various methods for increasing plating speed have heretofore been conceived. Among such methods are one in which the speed of movement of ions in the plating solution is increased by increasing the metal concentration therein, one in which chemical reactions taking place in the plating solution are made faster by increasing the temperature thereof, and one in which a thinner diffusion layer is formed by agitating plating solution in the vicinity of the cathode surface.

It is also well known in the art to increase the plating speed by moving the cathode and at the same time agitating the plating solution in the vicinity of the cathode surface. The agitation of plating solution to this end is done with various means. Among these means are one utilizing air agitation which is more intense than the usual agitation, one in which the entire plating solution is agitated with a propeller, one utilizing low frequency vibrations, one utilizing ultrasonic waves, and one utilizing pump recirculation of the plating solution to be jetted from a nozzle. These agitating means, however, have their own drawbacks. With air agitation, the current density is increased only up to a level corresponding to a couple of times the usual plating speed. Besides, it is extremely difficult in this case to obtain a uniform plating film thickness. In the case of propeller agitation of the entire plating solution, it is difficult to obtain uniform agitation with respect to a product. For this reason, this agitating means is hardly used. Utilizing low frequency vibrations is not very effective for increasing the plating speed; it permits only a plating speed increase comparable to that in the case of the air agitation. Utilizing ultrasonic waves readily results in a coarsened surface of material. Besides, the frequency used varies with the kind of plating solution. At present, therefore, this agitation method is hardly used.

Recently, a system as shown in FIG. 8 has been employed. In such system, a plurality of nozzles 51 are provided at a predetermined interval on a nozzle mounting pipe 50, and a plating solution supplied from a pump 52 is jetted upward from the nozzles 51 toward a workpiece 53 as shown by arrows. The plating solution which is collected in a lower portion of a plating solution tank 54 is recovered by the pump 52 through a discharge valve 55.

However, the system shown in FIG. 8, which utilizes pumped recirculation of the plating solution to be jetted from the nozzles 51 toward the workpiece 53, has some problems. When the plating solution strikes the portion of the workpiece 53 to be plated, its pressure is increased, thus increasing its jetting pressure difference and also its flow velocity difference in this portion. Therefore, a uniform flow velocity of the plating solution cannot be obtained over the surface of the workpiece 53, and a plating film 56 that is formed lacks thickness uniformity as shown in FIG. 9. Since the system can hardly form a uniformly thick plating film, it fails to meet the practical technical standard of the plating of sheet-like products having large areas, such as printed circuit boards, and also of hoop plating, although it can be utilized to plate only a portion of a product as shown in FIG. 9.

Another problem is that the disposition of the electrode and the nozzle is different with different kinds of products, and it is difficult to replace the electrode-and-nozzle set. In other words, the system can be used exclusively or is an exclusive system for a particular kind of product. A high cost of the product, therefore, is inevitable. A further problem is that hydrogen gas generated from the cathode surface readily forms many pinholes (i.e., holes formed after gas purging) in the obtained plating film. Moreover, the nozzles which are made of an insoluble metal such as Platinum dictate a high cost of replacement when they are worn out after long use.

OBJECTS AND SUMMARY OF THE INVENTION

An object of the invention is to provide, in a plating system utilizing pumped recirculation of plating solution jetted from a nozzle to a workpiece to be plated, a novel nozzle which can solve the problems discussed above in such plating system.

Another object of the invention is to permit formation of a uniformly thick plating film.

A further object of the invention is to permit increasing of the plating speed.

A still further object of the invention is to provide a nozzle which is capable of coping with workpieces having large areas.

To attain the above object of permitting the formation of a uniformly thick plating film, the invention features a nozzle which comprises an outer cylindrical member and an inner cylindrical member, and a plating solution jetting passage being defined between the outer and inner cylindrical members. The inner cylindrical member has a flared front end defining a diffusing portion having a forwardly flared surface spaced by a gap from a front open end of the outer cylindrical member, the gap constituting a jetting port of the plating solution jetting passage.

To attain the above object of permitting increasing of the plating speed, the invention features a construction which provides a recirculating state in which plating solution is jetted and sucked concurrently, thus maintaining a thin diffusion layer of plating solution as well as reducing differences of pressure and flow velocity. More specifically, the nozzle comprises an outer cylindrical member and an inner cylindrical member, a plating solution jetting passage being defined between the outer and inner cylindrical members, and in inner space in the inner cylindrical member constituting a plating solution sucking passage. The inner cylindrical member has a flared front end defining a diffusing portion having a forwardly flared surface. The outer cylindrical member has a front open end spaced by a gap with respect to the flared surface, the gap constituting a plating fluid jetting port. A plating solution supplied from a supply opening of the plating solution jetting passage is jetted from the jetting port toward a workpiece to be plated. The jetted plating solution is sucked or suctioned from a sucking port of the plating solution sucking passage, the sucked plating solution being discharged from a rear end discharge opening of the plating solution sucking passage. To provide the recirculating state in which the plating solution is jetted and sucked concurrently, the nozzle is constructed with a plating solution issuing pipe and a plating solution sucking pipe, a sucking port of the plating solution sucking pipe being provided in the vicinity of a jetting port of the plating solution jetting pipe so that the plating solution jetted from the issuing port can be sucked from the sucking port.

For electroplating a workpiece having a large area with a plating film, a number of nozzles capable of forming a uniformly thick plating film are disposed at a predetermined interval.

DETAILED DESCRIPTION OF THE PREFERRED EMBODIMENTS

Preferred embodiments of the invention will now be described with reference to the accompanying drawings.

Figure 1:
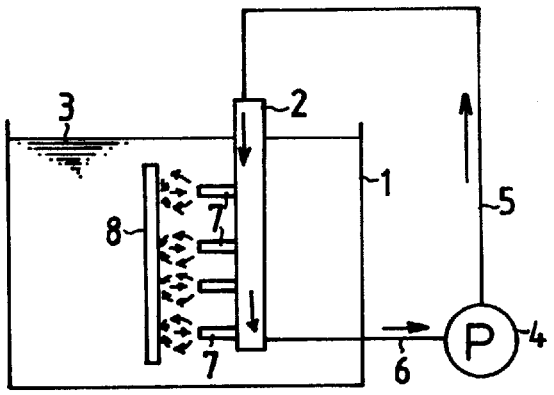
FIG. 1 is a schematic view showing a plating system using nozzles according to the invention.

FIG. 1 is a schematic view showing a plating system using nozzles according to the invention. Reference numeral 1 designates a plating solution tank, numeral 2 a nozzle mounting member disposed in a plating solution 3 in the plating solution tank 1, numeral 4 a recirculating pump disposed outside the plating solution tank 1, numeral 5 a supply duct line which connects a supply passage (to be described later) provided in the nozzle mounting member 2 and the recirculating pump 4, numeral 6 a duct line connecting a recovery passage (to be described later) provided in the nozzle mounting member 2 and the recirculating pump 4, numeral 7 nozzles mounted on the nozzle mounting member 2, and numeral 8 a workpiece to be plated.

Figure 2:
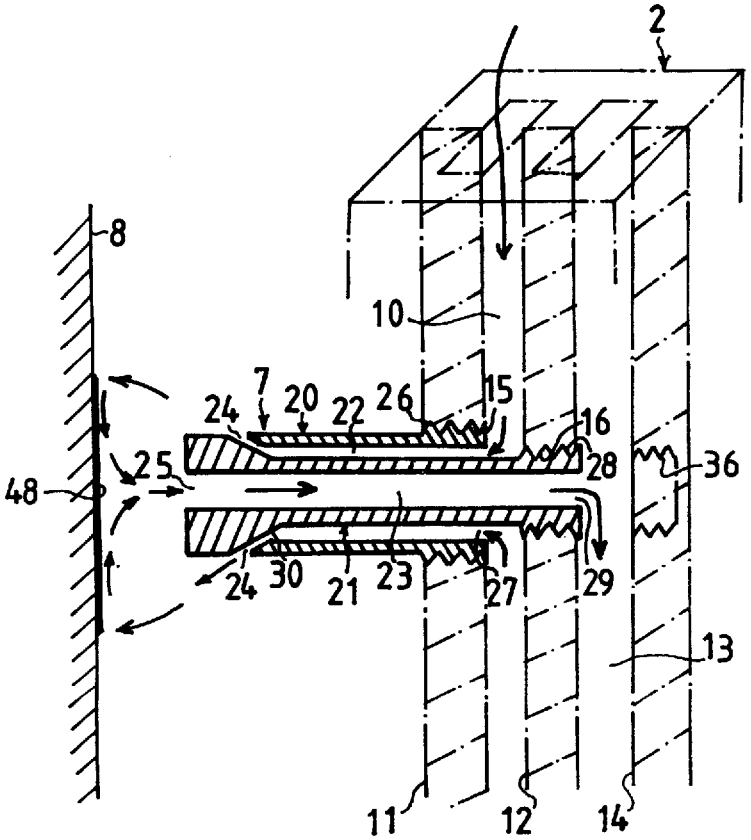
FIG. 2 is a fragmentary sectional view showing the plating system using a nozzle according to the invention.

The nozzles 7 and the nozzle mounting member 2 will now be described with reference to FIGS. 2 to 5. As shown in FIG. 2, the nozzle mounting member 2 has a supply passage 10, which is defined between a front wall 11 and an intermediate wall 12, and a recovery passage 13 which is defined between the intermediate wall 12 and a rear wall 14. The front wall 11 has a hole 15 with a female thread open to the supply passage 10. The intermediate wall 12 has a hole 16 with a female thread open to the recovery passage 13. The supply passage 10 is communicated via the supply duct line 5 to the discharge side of the recirculating pump 4. The recovery passage 13 is communicated via the recovery duct line 6 to the suction side of the recirculating pump 4.

Each nozzle 7 comprises an outer cylindrical member 20 and an inner cylindrical member 21 concentrically disposed therein such that a gap is defined between these cylindrical members 20 and 21. The gap defined between the two cylindrical members 20 and 21 serves as a plating solution jetting passage 22, and the inner space in the inner cylindrical member 21 serves as a plating solution sucking or suction passage 23. The front end of the plating solution jetting passage 22 constitutes a jetting port 24, from which the plating solution is jetted toward a workpiece 8 to be plated. The front end of the plating solution sucking passage 23 constitutes a sucking or suction port 25, from which the plating solution jetting from the jetting port 24 is sucked. The outer periphery of a rear end portion of the outer cylindrical member 20 has a male thread 26 which is screwed in the threaded hole 15 noted above. By screwing the male thread 26 in the threaded hole 15, the outer cylindrical member 20 is secured to the front wall 11 with the rear end opening 27 of the plating solution jetting passage 22 in communication with the supply passage 10 in the nozzle mounting member 2. The inner cylindrical member 21 has a rear end portion which extends rearward from the rear end of the outer cylindrical member 20 and has a male thread 28 which is screwed in the threaded hole 16 noted above. By screwing the male thread 28 in the threaded hole 16, the inner cylindrical member 21 is secured to the intermediate wall 12 with the rear end discharge opening 29 of the plating solution sucking passage 23 in communication with the recovery passage 13 in the nozzle mounting member 2.

The inner cylindrical member 21 has a flared front end portion 30 as a diffusing portion having a surface 31 divergingly flared forwardly. The outer cylindrical member 20 has its front open end located with a gap defined with respect to the flaring surface 31, the gap serving as jetting port 24 of the plating solution jetting passage 22. The inner periphery of the open end portion of the outer cylindrical member 20 has a chamfer 32 which has the same angle of inclination as the flared surface 31 of the flared portion 30.

The outer periphery of the inner cylindrical member 21 has a plurality of axial ridges 33 which are in loose contact at outer edges thereof with the inner periphery of the outer cylindrical member 20. The ridges 33 have a guide function for rectifying the flow of plating solution through the plating solution jetting passage 22 and also a guide function for making the outer and inner cylindrical members 20 and 21 to be coaxial with each other. These ridges 33, however, are not an essential prerequisite according to the invention, and the objects of the invention can be attained without ridges 33.

The nozzles 7 are made of a synthetic resin. As such synthetic resin may be used engineering plastics, such as hard vinyl chloride, heat-resistant vinyl chloride, polypropyrene, polyethylene, nylon, polyacetal, polytetrafluoroethylene, etc. These materials, however, are by no means limitative, and it is also possible to use other materials which are used for conventional nozzles.

Figure 5:
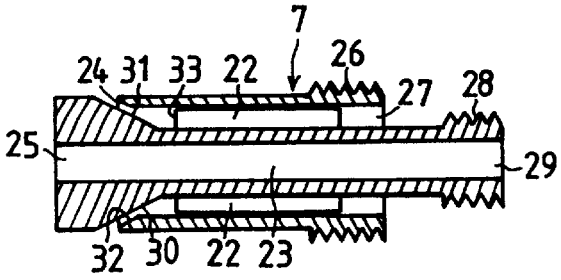
FIG. 5 is a sectional view showing the nozzle according to the invention.
Figure 6:
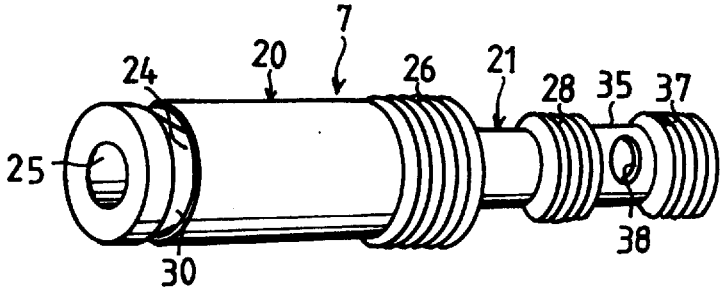
FIG. 6 is a perspective view showing a different embodiment of the invention.

FIG. 6 shows a different embodiment of the nozzle according to the invention. In this nozzle 7, the inner cylindrical member 21 has an extension 35 extending rearwardly from its portion with the male thread 28. The outer periphery of the extension 35 has a male thread 37 which is screwed in threaded hole 36 formed in the rear wall 14 (FIG. 2). The extension 35 has a discharge opening 38 open to the recovery passage 13. By adjusting the extent of screwing of the male thread 37 in the threaded hole 36, the area of the discharge opening 38 can be adjusted to adjust the rate of flow of the plating solution being sucked. The remainder of the construction of the nozzle 7 shown in FIG. 6 is the same as the nozzle 7 shown in FIGS. 3 to 5. In the nozzle 7 shown in FIGS. 3 to 5 and also the nozzle 7 in FIG. 6, the inner cylindrical member 21 is telescopically provided in the outer cylindrical member 20, and the inner cylindrical member 21 is secured to the outer cylindrical member 20 at a given position thereof by screwing the male threads 26, 28 and 37 in the threaded holes 15, 16 and 36, respectively. However, it is possible to form the outer and inner cylindrical members 20 and 21 together as a one-piece molding.

Figure 7:
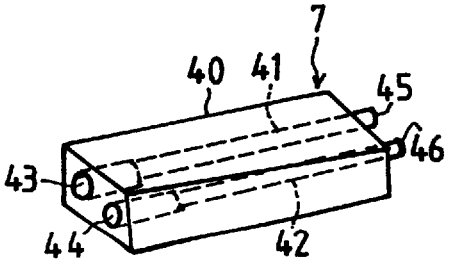
FIG. 7 is a perspective view showing a further embodiment of the nozzle according to the invention.
Figure 8:
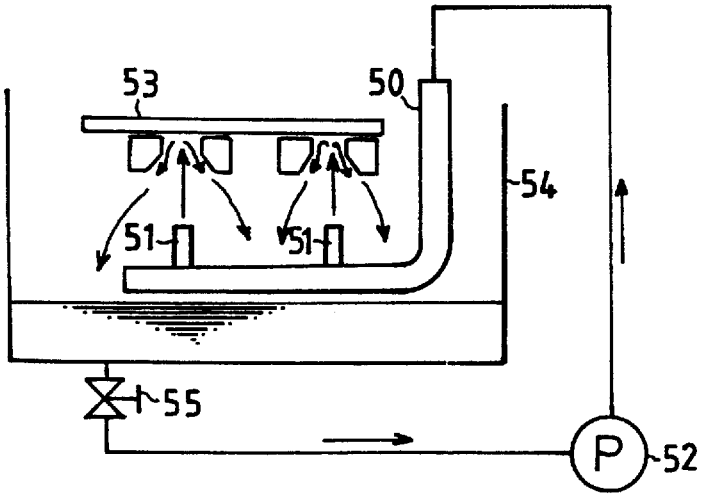
FIG. 8 PRIOR ART
FIG. 8 is a schematic view showing a prior art plating system.
Figure 9:
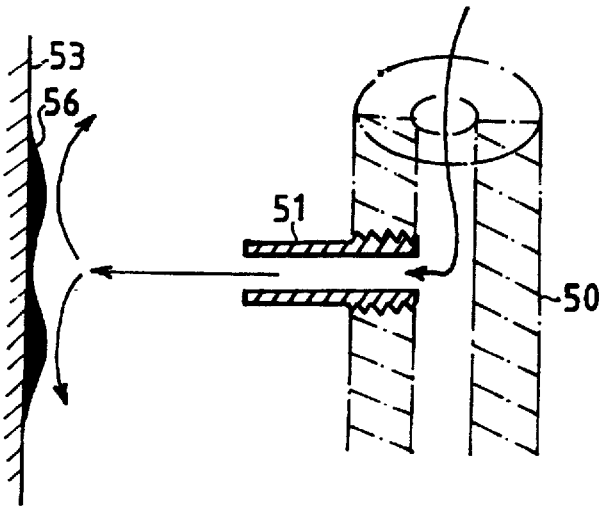
FIG. 9 PRIOR ART
FIG. 9 is a view illustrating the plating system shown in FIG. 8 in a plating state.

FIG. 7 shows a further embodiment of the nozzle according to the invention. This nozzle 7 comprises a box-like pipe mounting member 40 made of a synthetic resin, a plating solution jetting pipe 41 and a plating solution recovery pipe 42, these pipes 41 and 42 being mounted in the pipe mounting member 40. The plating solution jetting pipe 41 has a front end jetting port 43, from which the plating solution supplied from the recirculating pump 4 is jetted, and the plating solution recovery pipe 42 has a front end sucking or suction port 44, from which the plating solution jetting from the jetting port 43 is recovered. The plating solution jetting pipe 41 is provided at its rear end with a supply side coupler 45, which is communicated with the supply duct line 5 communicated with the discharge side of the recirculating pump 4, and the plating solution recovery pipe 42 is provided at the rear end with a recovery side coupler 46 which is communicated with the recovery duct line 6 communicated with the suction side of the recirculating pump 4.

While in the construction shown in FIG. 7 the jetting port 43 and the sucking port 44 are disposed side by side as a pair, this is by no means limitative. For example, it is possible to provide numbers of ports in vertical or horizontal rows, or to provide a number of small diameter jetting ports 43 around the sucking port 44.

Figure 3:
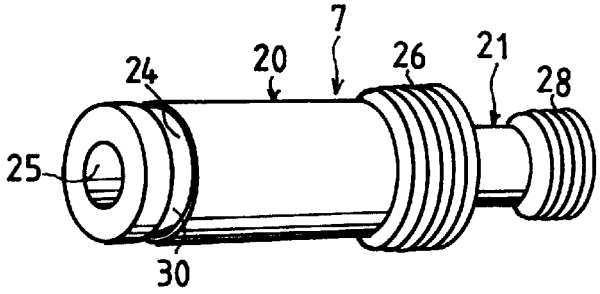
FIG. 3 is a perspective view showing the nozzle according to the invention.
Figure 4:
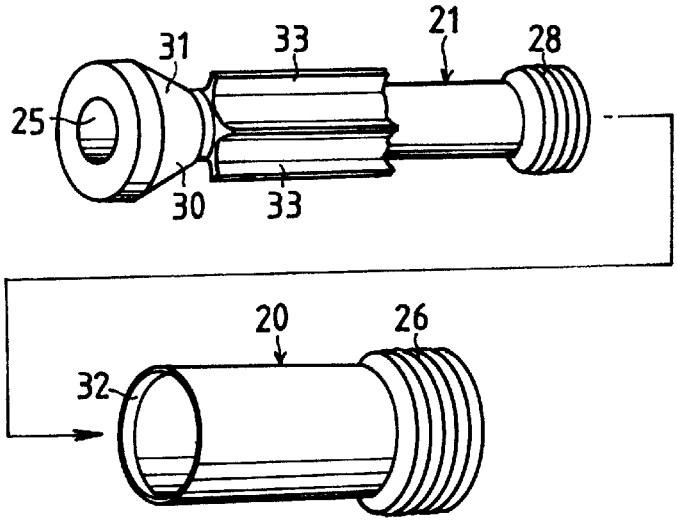
FIG. 4 is an exploded perspective view showing the nozzle according to the invention.

The manner of use of the nozzle according to the invention will now be described. First, as shown in FIGS. 3 to 5, the inner cylindrical member 21 is inserted from its end adjacent the male thread 28 into the outer cylindrical member 20 from the end thereof adjacent the jetting port 24 such that its male thread 28 projects outward from the rear end of the outer cylindrical member 20. Then, as shown in FIG. 2, the inner cylindrical member 21 is mounted in the nozzle mounting member 2 by screwing its male thread 28 in the threaded hole 16 formed in the intermediate wall 12 of the nozzle mounting member 2. At the same time, the outer cylindrical member 20 is mounted in the nozzle mounting member 2 by screwing its male thread 26 in the threaded hole 15 formed in the front wall 11 of the nozzle mounting member 2. Subsequently, by turning the outer cylindrical member 20 or the inner cylindrical member 21 the chamfer 32 of the outer cylindrical member 20 at the front open end thereof is located so as to provide a gap between it and the flared surface 31 of the front end flared portion 30 of the inner cylindrical member 21. The gap which serves as the jetting port 24 is thus adjusted such that it corresponds to a desired flow rate. A number of nozzles 7 are mounted in the above way in the nozzle mounting member 2, which is then disposed in the plating solution tank 1 (FIG. 1), and the workpiece 8 to be plated is set.

To plate the workpiece 8 with the nozzles 7 according to the invention, the recirculating pump 4 is driven. As a result, a plating solution is caused to flow into the supply passage 10 in the nozzle mounting member 2 as shown by arrows in FIG. 2, and thence through the supply opening 27 and plating solution jetting passage 22 of each nozzle 7 and to be jetted from the jetting port 24 toward the workpiece 8. At this time, unlike the prior art nozzle, the plating solution is not jetted in a straight manner but is jetted in a diffused fashion. The jetted plating solution strikes the the surface of the workpiece 8. Since a suction force provided by the recirculating pump 4 is present at the sucking port 25 of the sucking passage 23, the plating solution used for the formation of a plating film on the surface of the workpiece 8 is sucked or drawn into the sucking passage 23 from the sucking port 25. The plating solution sucked from the sucking port 26 flows through the inner cylindrical member 21, i.e., the sucking passage 23, and is discharged from the discharge opening 29 into the recovery passage 13 in the nozzle mounting member 2 and recovered to the suction side of the recirculating pump 4. As described above, the plating system according to the invention has such a construction that one nozzle has a jetting port and a sucking port for jetting and sucking a plating solution and provides recirculation in which the plating solution is jetted and sucked concurrently relative to the workpiece surface portion to be plated. The diffusion layer thus can remain thin even with a pressure increase, and differences of pressure and flow speed can be reduced. Thus, the invention can solve the problem of the prior art nozzle that it is difficult to electroplate ions due to scattering of a plating solution under a high pressure, and can provide extremely uniform electroplating. It is thus possible to form a uniformly thick plating film 48 as shown in FIG. 2 on the workpiece surface. In addition, according to the invention hydrogen gas generated from the cathode surface is forcibly sucked from the sucking port 25 and removed, so that it is possible to obtain a plating film with fewer pinholes.

The plating solution recovered into the recovery passage 13 of the nozzle mounting member 2, is sucked by the recirculating pump 4 and recirculated through the supply duct line 5 and the supply passage 10 in the nozzle mounting member 2 to the supply opening of each nozzle 7. In the case of using the nozzle 7 shown in FIG. 7, a plating solution flows through the supply side coupler 45 and the jetting pipe 41 and is jetted from the jetting port 43. The diffused plating solution is sucked from the sucking port 44, and recirculated through the discharge side coupler 46 and the recovery duct line 6.

The recovery of the plating solution may be made more reliable by locating the sucking port 44 to be projected with respect to the jetting port 43.

As has been described in the foregoing, the nozzle according to the invention comprises the inner cylindrical member 21 having the flared portion 30 for diffusing a plating solution and the outer cylindrical member 20 which is capable of adjusting the diffusion and the rate of flow of the plating solution It is thus possible to increase the plating speed and form a uniformly thick plating film 48 on the workpiece surface. It is further possible to quickly remove hydrogen gas generated from the cathode surface and obtain a plating film with fewer pinholes, thus improving the durability of the plating film. The recirculating pump 4 according to the invention may be of a minimum capacity, thus permitting reduction of operating cost. By providing a number of nozzles according to the invention, it is possible, unlike the prior art, to plate a workpiece having a large area. According to the invention, a single nozzle has a jetting port and a sucking port for jetting and sucking a plating solution, and it is possible to simplify the construction of the plating system compared to the prior art system.

The invention is applicable, in addition to fast plating, to processes involving electrolysis, such as almite processing and electrolytic polishing, and also to etching processes, so that it is extremely beneficial.

What is claimed is:

1. A plating system comprising a nozzle mounting member disposed in a plating solution in a plating solution tank and having a supply passage and a recovery passage, a recirculating pump disposed outside said plating solution tank, a supply duct line connecting said supply passage and said recirculating pump, a recovery duct line connecting said recovery passage and said recirculating pump, and a nozzle mounted in said nozzle mounting member for jetting the plating solution toward a workpiece to be plated, said nozzle being adapted to provide the functions both of jetting and suctioning the plating solution and comprising:

an outer cylindrical member and an inner cylindrical member coaxially disposed in said outer cylindrical member with a gap defined between said outer and inner cylindrical members, said gap defined between said outer and inner cylindrical members constituting a plating solution jetting passage, an inner space in said inner cylindrical member constituting a plating solution suction passage, a front end of said plating solution jetting passage constituting a jetting port for jetting the plating solution toward the workpiece to be plated, a front end of said plating solution suction passage constituting a suction port for suctioning the plating solution jetted from said jetting port, said plating solution jetting passage having a rear end supply opening communicated with said supply passage in said nozzle mounting member, said plating solution suction passage having a rear end discharge opening communicated with said recovery passage in said nozzle mounting member, said inner cylindrical member having a flared front end portion having a forwardly flared surface spaced by a gap from a front open end of said outer cylindrical member to thereby define said jetting port of said plating solution jetting passage.

2. A system as claimed in claim 1, wherein said inner cylindrical member has a rear end extending rearwardly with respect to a rear end of said outer cylindrical member, said supply passage is defined between a front wall and an intermediate wall of said nozzle mounting member, said recovery passage is defined between said intermediate wall and a rear wall of said nozzle mounting member, said front wall has a hole with a female thread and open to said supply passage, said intermediate wall has a hole with a female thread and open to said recovery passage, an outer periphery of a rear end portion of said outer cylindrical member has a male thread screwed in said hole in said front wall, and an outer periphery of a rear end portion of said inner cylindrical member has a male thread screwed in said hole in said intermediate wall.

3. A system as claimed in claim 2, wherein said inner cylindrical member has a rearward extension extending rearwardly from said rear end portion with said male thread, an outer periphery of a rear end portion of said rearward extension has a male thread screwed in a hole with a female thread formed in said rear wall, and said rearward extension has a discharge opening communicated with said recover passage.

4. A system as claimed in claim 1, wherein an outer periphery of said inner cylindrical member has a plurality of axial ridges having outer edges in loose contact with an inner periphery of said outer cylindrical member.

5. A nozzle assembly to be employed as part of a plating system for use in plating a workpiece, said nozzle assembly comprising:

a nozzle mounting member to be disposed in a plating solution in a plating solution tank, said nozzle mounting member having a supply passage and a recovery passage to be connected to a recirculating pump of the system; and a nozzle mounted in said nozzle mounting member for jetting the plating solution toward the workpiece, said nozzle being adapted to provide the functions both of jetting and suctioning the plating solution and comprising an outer cylindrical member and an inner cylindrical member coaxially disposed in said outer cylindrical member with a gap defined between said outer and inner cylindrical members, said gap defined between said outer and inner cylindrical members constituting a plating solution jetting passage, an inner space in said inner cylindrical member constituting a plating solution suction passage, a front end of said plating solution jetting passage constituting a jetting port for jetting the plating solution toward the workpiece, a front end of said plating solution suction passage constituting a suction port for suctioning the plating solution jetted from said jetting port, said plating solution jetting passage having a rear end supply opening communicated with said supply passage in said nozzle mounting member, said plating solution suction passage having a rear end discharge opening communicated with said recovery passage in said nozzle mounting member, said inner cylindrical member having a flared front end portion having a forwardly flared surface spaced by a gap from a front open end of said outer cylindrical member to thereby define said jetting port of said plating solution jetting passage.

6. An assembly as claimed in claim 5, wherein said inner cylindrical member has a rear end extending rearwardly with respect to a rear end of said outer cylindrical member, said supply passage is defined between a front wall and an intermediate wall of said nozzle mounting member, said recovery passage is defined between said intermediate wall and a rear wall of said nozzle mounting member, said front wall has a hole with a female thread and open to said supply passage, said intermediate wall has a hole with a female thread and open to said recovery passage, an outer periphery of a rear end portion of said outer cylindrical member has a male thread screwed in said hole in said front wall, and an outer periphery of a rear end portion of said inner cylindrical member has a male thread screwed in said hole in said intermediate wall.

7. An assembly as claimed in claim 6, wherein said inner cylindrical member has a rearward extension extending rearwardly from said rear end portion with said male thread, an outer periphery of a rear end portion of said rearward extension has a male thread screwed in a hole with a female thread formed in said rear wall, and said rearward extension has a discharge opening communicated with said recovery passage.

8. An assembly as claimed in claim 5, wherein an outer periphery of said inner cylindrical member has a plurality of axial ridges having outer edges in loose contact with an inner periphery of said outer cylindrical member.

9. A nozzle to be employed in a plating system for use in plating a workpiece, said nozzle being capable of providing functions of both jetting a plating solution toward the workpiece and of suctioning the plating solution from the workpiece, said nozzle comprising:

an outer cylindrical member and an inner cylindrical member coaxially disposed in said outer cylindrical member with a gap defined between said outer and inner cylindrical members, said gap defined between said outer and inner cylindrical members constituting a plating solution jetting passage, an inner space in said inner cylindrical member constituting a plating solution suction passage, a front end of said plating solution jetting passage constituting a jetting port for jetting the plating solution toward the workpiece, a front end of said plating solution suction passage constituting a suction port for suctioning the plating solution jetted from said jetting port, said plating solution jetting passage having a rear end supply opening, said plating solution suction passage having a rear end discharge opening, said inner cylindrical member having a flared front end portion having a forwardly flared surface spaced by a gap from a front open end of said outer cylindrical member to thereby define said jetting port of said plating solution jetting passage.

10. A nozzle as claimed in claim 9, wherein said inner cylindrical member has a rear end extending rearwardly with respect to a rear end of said outer cylindrical member, an outer periphery of a rear end portion of said outer cylindrical member has a male thread for mounting of said outer cylindrical member, and an outer periphery of a rear end portion of said inner cylindrical member has a male thread for mounting of said inner cylindrical member.

11. A nozzle as claimed in claim 10, wherein said inner cylindrical member has a rearward extension extending rearwardly from said rear end portion with said male thread, an outer periphery of a rear end portion of said rearward extension has a male thread, and said rearward extension has therethrough a discharge opening.

12. A nozzle as claimed in claim 9, wherein an outer periphery of said inner cylindrical member has a plurality of axial ridges having outer edges in loose contact with an inner periphery of said outer cylindrical member.

* * * * *